US006776217B1

(12) United States Patent
Streubel et al.

(10) Patent No.: US 6,776,217 B1
(45) Date of Patent: Aug. 17, 2004

(54) METHOD FOR CONTINUOUS CASTING OF SLAB, IN PARTICULAR, THIN SLAB, AND A DEVICE FOR PERFORMING THE METHOD

(75) Inventors: Hans Streubel, Erkrath (DE); Uwe Plociennik, Ratingen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/715,933

(22) Filed: Nov. 17, 2000

(30) Foreign Application Priority Data

Nov. 25, 1999 (DE) ..... 199 56 577

(51) Int. Cl.[7] ..... B22D 11/16; B22D 11/20; B22D 11/22

(52) U.S. Cl. ..... 164/454; 164/452; 164/455

(58) Field of Search ..... 164/452, 453, 164/454, 455, 154.6, 155.6, 151.4, 151.5, 450.3, 413, 414

(56) References Cited

U.S. PATENT DOCUMENTS 4,553,604 A * 11/1985 Yaji et al. ..... 164/452

FOREIGN PATENT DOCUMENTS

| | | |
|---|---|---|
| DE | 3423475 | 11/1984 |
| DE | 4117073 | 3/1993 |
| DE | 195 29 931 C1 | 4/1997 |
| DE | 198 10 672 A1 | 9/1999 |
| EP | 0110817 | 6/1984 |
| JP | 6-304727 | * 11/1994 |
| JP | 6-320245 | * 11/1994 |
| WO | 9704900 | 2/1997 |

OTHER PUBLICATIONS

Patent Abstracts of Japan, vol. 012, No. 343 (M–741), Sep. 14, 1988 & JP 63 104754 A (Mitsubishi Heavy Ind Ltd), May 10, 1988.

Patent Abstracts of Japan, vol. 014, No. 058 (M–0930), Feb. 2, 1990 & JP 01 284470 A (Kawasaki Steel Corp), Nov. 15, 1989.

Patent Abstracts of Japan, vol. 007, No. 271 (M–260), Dec. 3, 1983 & JP 58 151952 A (Kobe Seikosho KK), Sep. 9, 1983.

* cited by examiner

*Primary Examiner*—Kuang Y. Lin
(74) *Attorney, Agent, or Firm*—Friedrich Kueffner

(57) ABSTRACT

In a method for continuous casting bars, billets, and slabs from a melt in dimensional ranges of approximately 20 to 150 mm thickness and approximately 600 to 3500 mm width by means of an oscillating, water-cooled casting mold in cooperation with a submerged-entry nozzle and by employing casting powder for formation of casting slag, local temperatures and local heat flux densities of a casting mold wall in a meniscus area of the melt critical for the surface quality of a slab are measured. The working temperature of the casting mold wall in the meniscus area is maintained by adjusting the operating parameters important for the working temperature within a predetermined temperature range (ΔT).

1 Claim, 1 Drawing Sheet

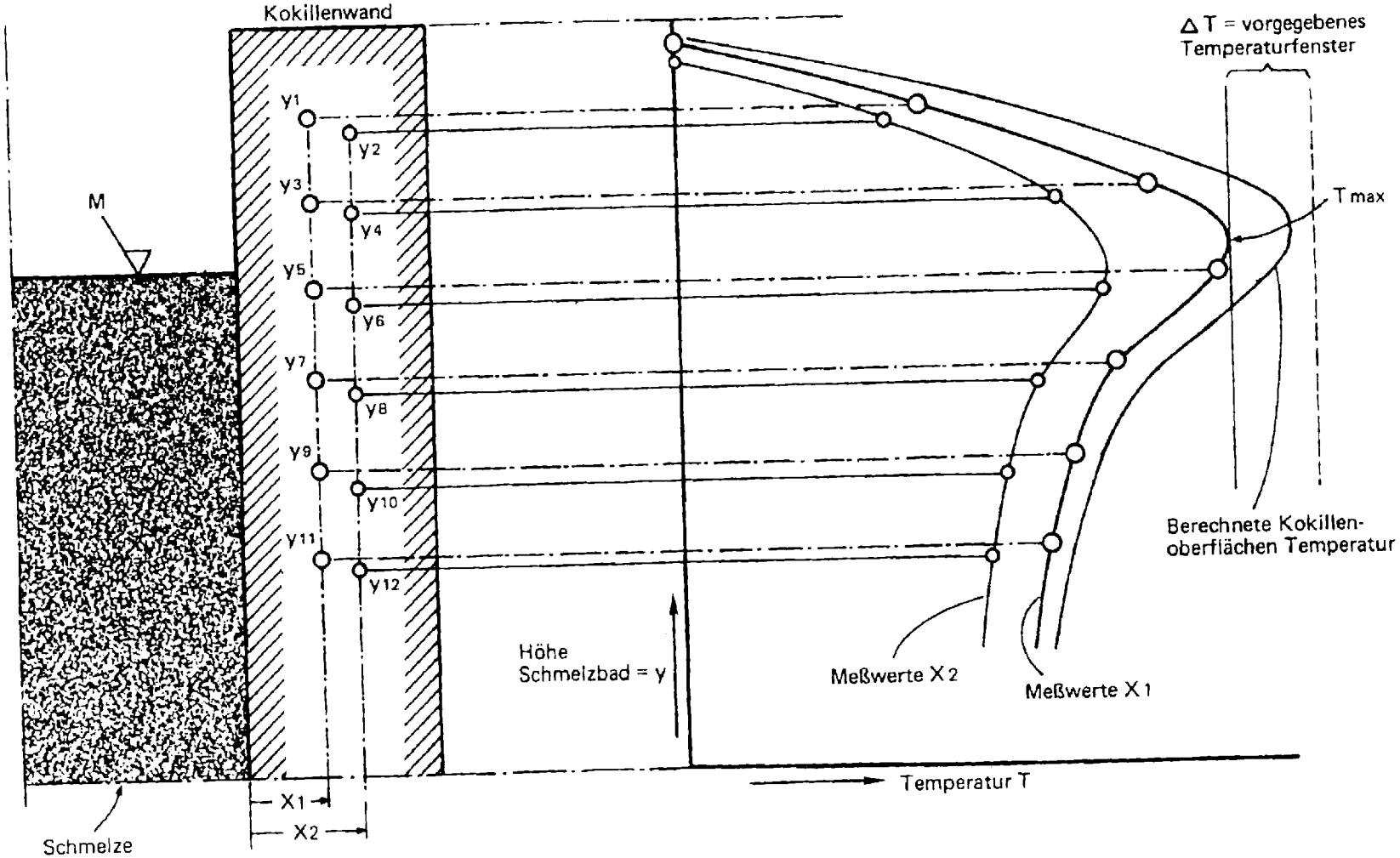
ΔT = vorgegebenes Temperaturfenster
T max
Berechnete Kokillen-oberflächen Temperatur
Meßwerte X1
Meßwerte X2
Temperatur T
Höhe Schmelzbad = y
Kokillenwand
y1
y2
y3
y4
y5
y6
y7
y8
y9
y10
y11
y12
X1
X2
M
Schmelze

METHOD FOR CONTINUOUS CASTING OF SLAB, IN PARTICULAR, THIN SLAB, AND A DEVICE FOR PERFORMING THE METHOD

BACKGROUND OF THE INVENTION

1. Field of the Invention

The invention relates to a method for continuous casting of bars, billets, slabs, in particular, thin slabs, in dimensional ranges of approximately 20 to 150 mm thickness and approximately 600 mm to 3,500 mm width, by means of an oscillating, water-cooled casting mold in cooperation with a submerged-entry nozzle with use of casting powder for forming casting cinder. The invention relates also to a device for performing the method.

2. Description of the Related Art

Methods and devices for continuous casting, in particular, of thin slab, are known and have been continuously improved during the course of the past developmental periods.

For example, it is known that, as a result of very different thermal conductivities of the different media interacting during continuous casting and the thus resulting resistances against thermal conduction and heat transmission, the formation of a strand skin of a continuous cast strand presently being formed and especially its surface properties are variable within relatively wide limits. In particular, during thermal contact between the molten bath and the casting mold wall the thickness of the liquid cinder or slag of melted casting powder plays an important role because of its extremely minimal specific conductivity of approximately 1 W/K×m because it presents a significant resistance for the heat transmission between the melt and the casting mold plates. In contrast to the liquid slag, copper has an extremely high thermal conductivity of approximately 360 W/K×m.

As a result of the different individual resistance values of the thermal conductivity between copper, slag, and steel, different heat flux densities result within the casting mold plates which have a considerable effect on the solidification behavior of a strand to be cast.

The prior art published in connection with this problem includes, for example, documents DE 41 17 073 C2, DE 195 29 931 A1, and DE 198 10 672 A1.

In DE 41 17 073 C2 the temperature recordings of four water-cooled casting mold plates as integral values of each individual plate are measured and evaluated. No partial measured values across the casting mold width are determined, and, in principle, the water quantity for cooling is not changed.

In DE 195 29 931 A1 a slab casting mold is described which is comprised of at least three independent cooling chamber segments which have separate connectors for an independent supply of casting mold cooling water in the area of the casting mold outlet. This arrangement is designed to detect asymmetries of the specific heat flux between the area of the submerged-entry nozzle and the remaining casting mold areas and to compensate them by conicality adjustment of the narrow sides of the casting mold and by cooling water regulation.

DE 198 10 672 A1 describes a method for measuring and controlling temperature and amount of the cooling water of a continuous casting mold per time unit flowing through water-coolable casting mold walls of copper plates, in particular, mold walls that are independent from one another. The invention resides in that the cooling water temperature of a casting mold wall is measured at least at two locations in the area of the outflow openings of a copper plate and the correlated water box and, based on the values measured across the width of the copper plate, a temperature profile is produced and the temperature profiles obtained in time intervals are compared with one another. In this connection, the inflow temperature of the cooling water is measured, the difference of the inflow and outflow temperatures is determined, and, based on the cooling water amount per time unit, the partial integral heat transfer from a casting mold wall or a casting band area is determined, and partial inequalities are compensated by partial quantity corrections of the cooling water. The liquid-cooled casting mold for performing the method is designed such that in the water outflow area between a copper plate and the cooling water outflow opening of the water box, temperature sensors are arranged, in particular, at least at two locations per wide side plate, and their signal lines are connected to a computer, preferably provided with an online monitor.

SUMMARY OF THE INVENTION

It is an object of the present invention to provide a method and a device for continuous casting of bars, billets, slabs, in particular, thin slabs, which are suitable to measure local temperatures and/or heat flux densities along the height of the casting mold walls and at several locations of its width extension and, based on this, to calculate the temperature load of the casting mold walls in contact with the melt, preferably in the meniscus area. By means of the measured values the operating parameters such as cooling water amount, casting speed, and casting powder are to be controlled such that at a preferred working temperature of the casting mold walls in the meniscus area an optimal surface formation of the slabs is made possible together with an availability of the casting mold as long as possible.

In accordance with the present invention, this is achieved with respect to the method in that the local temperatures and heat flux densities are measured in the meniscus area, which is critical for the surface quality of a slab, and that the working temperatures of the casting mold plates in the meniscus area are maintained within a predetermined temperature range ($\Delta T$) by adjustment of the operating parameters decisive therefor, such as the amount or throughput speed of the cooling water through the casting mold, casting speed, and casting powder to be used.

Accordingly, the temperature course along the height of the casting mold plates is determined and, based on this course, the maximum temperatures and thus the location of the meniscus area of the melt in the casting mold are determined. When the optimal heat flux density is known, it is possible to improve the surface quality of the products produced in the continuous casting process, especially for thin slabs.

One embodiment of the method suggests that the working temperatures of the casting mold plates are measured by thermoelements arranged at a defined spacing and within a height level (Yi i=1 to n) above and below the bath level (M), respectively.

In a further embodiment of the method according to the invention, it is proposed that the thermoelements are arranged at different depths ($X_1$, $X_2$) of the wall of the casting mold and that, based on the temperature difference of at least two thermoelements positioned approximately at the same height area (Yi, e.g., $y_1$, $y_2$), the corresponding local heat flux density is calculated.

The thus determined results in regard to the course of the heat flux density make it possible to correct online deviations from a predetermined course with the accordingly provided operational parameters.

Moreover, an embodiment of the method according to the invention proposes that, by determining the temperature course or heat flux course along the height of a wall of the casting mold, the maximum temperature course of the wall surface in contact with the melt is determined by means of approximation functions. According to a further development of the method it is suggested that, when detecting a heat flux density change at the height (y) of the casting mold as a result of two-dimensional heat distribution in the bath level area (M), the position of the bath level (M) is determined online by employing an assumed heat flux density course at one surface of the casting mold and the known heat flux density in the depth (x) of a casting mold wall.

Finally, a further embodiment of the method according to the invention suggests that the best suited casting mold thermal load for an optimal slab surface formation is controlled by adjusting the cooling water quantity and/or the casting speed and/or the casting powder, when the optimal heat flux density or the maximum surface temperature of the casting mold is known.

A device according to the invention, provided for performing the method according to the invention of measuring local temperatures and/or heat flux densities on a water-cooled casting mold during continuous casting of bars, billets, slabs, in particular, thin slabs, is defined in that thermoelements are embedded in a paired arrangement in the wide lateral sidewalls of the casting mold in an area above and below the bath level and with approximately identical spacing from its contact surface with the melted liquid metal. The thermoelements are connected via signal lines with a computer unit which, based on the measured temperature or heat flux density, calculates the surface temperature of the casting mold in the meniscus area and, for controlling a preferred working temperature of the casting mold wall within a predetermined temperature range (ΔT), adjusts the operating parameters cooling water quantity, casting speed, as well as casting powder.

BRIEF DESCRIPTION OF THE DRAWING

In the drawing:

FIG. 1 shows a temperature profile or a heat flux course along the height (y) of a casting mold wall as well as in at least two spaced areas ($x_1$, $x_2$) of the casting mold wall spaced from the melt bath (M).

DESCRIPTION OF THE PREFERRED EMBODIMENTS

The temperature profile or heat flux course along the height (y) of a continuous casting wall as well as in at least two spaced areas ($x_1$, $x_2$) of the casting mold wall spaced from the melt bath (M) is illustrated in FIG. 1. The course of the curve shown in solid line ($y_1$, $y_3$, $y_5$, $y_7$, $y_9$, $y_{11}$) shows a definite temperature maximum ($T_{max}$) in the area of a predetermined temperature range (ΔT). The measuring points ($y_2$, $y_4$, $y_6$, $y_8$, $y_{10}$, $y_{12}$), positioned farther into the interior of the casting mold wall, show a similar curve with temperature maximum ($T_{max}$) in the meniscus area (M). Based on the measured temperature profiles the temperature profile of the casting mold surface is calculated.

The temperature curves can be recorded online and shown on a display by means of an electronic measuring device. They can be used to keep the temperature constant in the predetermined temperature window (ΔT) by automatic control of the decisive operating parameters in order to achieve an optimal surface formation, for example, in the case of a thin slab.

While specific embodiments of the invention have been shown and described in detail to illustrate the inventive principles, it will be understood that the invention may be embodied otherwise without departing from such principles.

What is claimed is:

1. In a method for continuous casting bars, billet, and slabs from a melt in dimensional ranges of approximately 20 to 150 mm thickness and approximately 600 to 3500 mm width by means of an oscillating, water-cooled casting mold in cooperation with a submerged-entry nozzle, employing casting powder for formation of casting slag, the method including the steps of:

measuring local temperatures and local heat flux densities of a casting mold in a meniscus area of the melt critical for the surface quality of a slab;

maintaining working temperatures of the casting mold plates in the meniscus area within a predetermined temperature range (ΔT) by adjusting operating parameters selected from the group consisting of the quantity of the cooling water, the throughput speed of the cooling water through the casting mold, the casting speed, and the casting powder to be used;

arranging thermoelements in the casting mold plates at a defined spacing from one another and within a height range above and below the bath level, respectively, for determining the working temperatures of the casting mold plates, wherein the thermoelements are arranged at different depths in the casting mold wall and wherein, based on a temperature difference of at least two of the thermoelements positioned substantially at the same height, the corresponding local heat flux density is calculated;

calculating a maximum temperature course of the wall surface in contact with the melt by means of approximation functions, based on a measurement of the course of the local temperatures or the heat flux along a height of the casting mold wall;

the improvement comprising:

determining when a change of the heat flux density is measured along the height of the casting mold wall as a result of two-dimensional heat transfer in the area of the bath level (M), the position of the bath level (M) based on an assumed heat density course in a casting mold surface and the known heat flux density in the depth (x) of a casting mold wall; and controlling, when knowing the optimal flux density or the maximum mold surface temperature, the best suited casting mold thermal load for an optimal slab surface formation by adjusting at least one of the operating parameters selected from the group consisting of cooling water quantity and casting speed and casting powder such that to maintain the maximum mold surface temperature at the bath level (M) within a predetermined temperature range (ΔT).

* * * * *